US010907868B2

(12) United States Patent
Shan

(10) Patent No.: US 10,907,868 B2
(45) Date of Patent: Feb. 2, 2021

(54) PERFORMANCE BOOSTED REFRIGERATION HEATING SYSTEM

(71) Applicant: DENSO International America, Inc., Southfield, MI (US)

(72) Inventor: Zhiwei Shan, Rochester, MI (US)

(73) Assignee: DENSO International America, Inc., Southfield, MI (US)

( * ) Notice: Subject to any disclaimer, the term of this patent is extended or adjusted under 35 U.S.C. 154(b) by 149 days.

(21) Appl. No.: 16/258,160

(22) Filed: Jan. 25, 2019

(65) Prior Publication Data

US 2019/0310000 A1 Oct. 10, 2019

Related U.S. Application Data

(60) Provisional application No. 62/655,410, filed on Apr. 10, 2018.

(51) Int. Cl.

| | |
|---|---|
| ***F25B 39/02*** | (2006.01) |
| ***F25B 31/00*** | (2006.01) |
| ***F25B 39/04*** | (2006.01) |

(52) U.S. Cl.

CPC ..... *F25B 39/02* (2013.01); *F25B 31/00* (2013.01); *F25B 39/04* (2013.01); *F25B 2339/0242* (2013.01)

(58) Field of Classification Search

CPC ..... B60H 1/00278; B60H 1/00885; B60H 1/00899; B60H 2011/00949; B60H 2001/3257; B60H 2001/3238; B60H 2001/00949; B60H 1/321; B60H 1/13213; F25B 41/04

See application file for complete search history.

(56) References Cited

U.S. PATENT DOCUMENTS

| | | | | |
|---|---|---|---|---|
| 9,989,289 | B2 * | 6/2018 | Zolli | F25B 49/027 |
| 2012/0138270 | A1 * | 6/2012 | Park | F25B 39/04 165/104.19 |
| 2018/0017298 | A1 * | 1/2018 | Dziubinschi | F25B 43/006 |

* cited by examiner

*Primary Examiner* — Cassey D Bauer
(74) *Attorney, Agent, or Firm* — Harness, Dickey & Pierce, P.L.C.

(57) ABSTRACT

A heating system including a condenser and an evaporator. A compressor is along a refrigerant line and is configured to compress refrigerant flowing to the condenser. A first valve is along the refrigerant line between the compressor and the condenser. A controller is configured to partially close the first valve when a measured temperature is below a threshold to increase discharge pressure of refrigerant compressed by the compressor and increase heat dissipation of the condenser.

20 Claims, 2 Drawing Sheets

PERFORMANCE BOOSTED REFRIGERATION HEATING SYSTEM

CROSS-REFERENCE TO RELATED APPLICATION

This application claims the benefit of U.S. Provisional Application No. 62/655,410 filed on Apr. 10, 2018, the entire disclosure of which is incorporated herein by reference.

FIELD

The present disclosure relates to a heating system for a vehicle.

BACKGROUND

This section provides background information related to the present disclosure, which is not necessarily prior art.

While current vehicle heating systems are suitable for their intended use, they are subject to improvement. For example, a heating system that provides increased heating performance in very cold weather conditions, without the need for additional components and cost, would be desirable. The present disclosure includes a heating system that provides these advantages, as well as numerous additional advantages and unexpected results as explained in detail herein and as one skilled in the art will recognize.

SUMMARY

This section provides a general summary of the disclosure, and is not a comprehensive disclosure of its full scope or all of its features.

The present disclosure includes a heating system having a condenser and an evaporator. A compressor is along a refrigerant line, and is configured to compress refrigerant flowing to the condenser. A first valve is along the refrigerant line between the compressor and the condenser. A controller is configured to partially close the first valve when a measured temperature is below a threshold to increase discharge pressure of refrigerant compressed by the compressor and increase heat dissipation of the condenser.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of select embodiments and not all possible implementations, and are not intended to limit the scope of the present disclosure.

Figure 1:
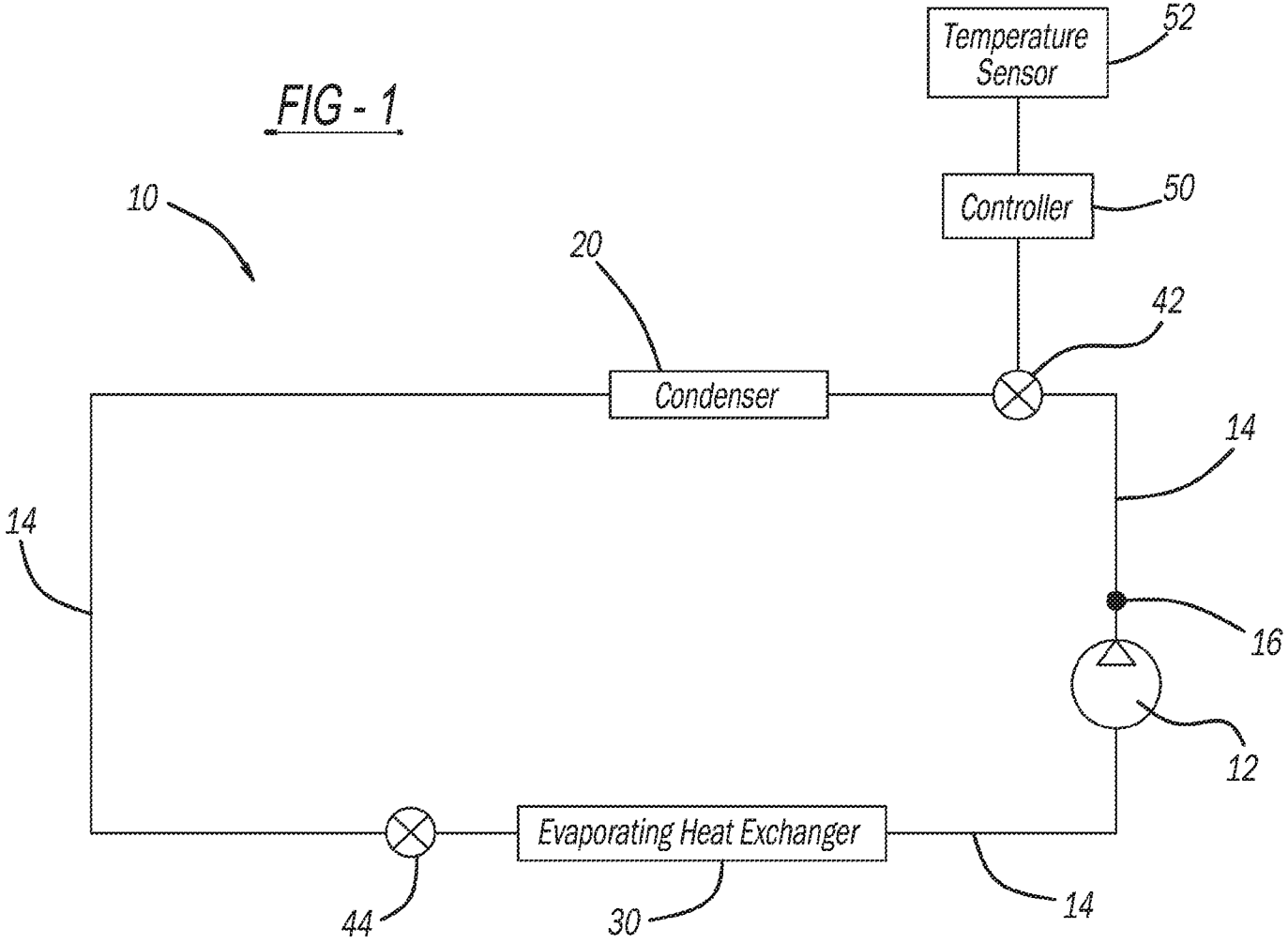
Figure 2:
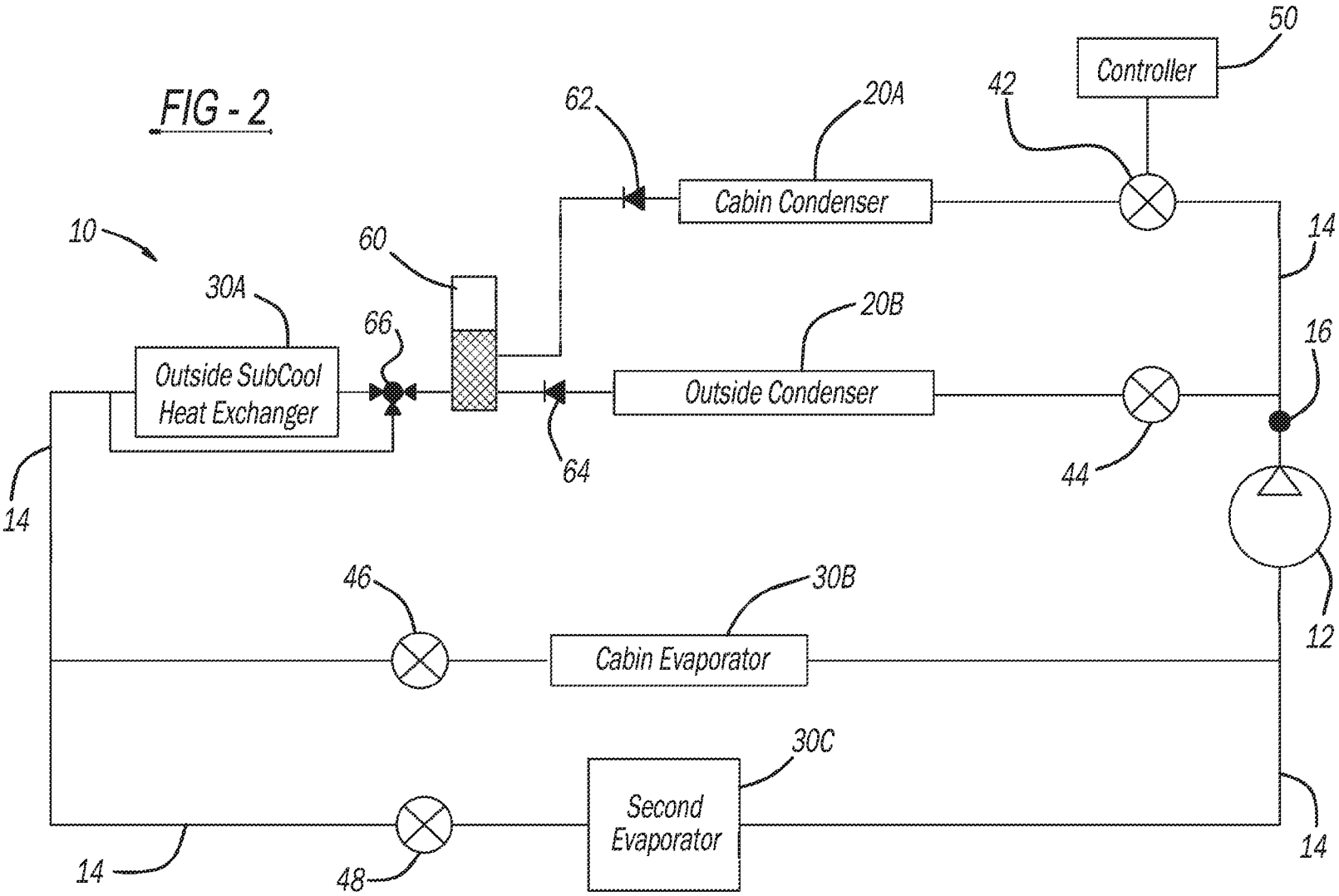

FIG. 1 illustrates an exemplary heating system in accordance with the present disclosure; and FIG. 2 illustrates another exemplary heating system in accordance with the present disclosure.

Corresponding reference numerals indicate corresponding parts throughout the several views of the drawings.

DETAILED DESCRIPTION

Example embodiments will now be described more fully with reference to the accompanying drawings.

With initial reference to FIG. 1, an exemplary heating system in accordance with the present disclosure is illustrated at reference numeral 10. The heating system 10 may be configured for heating any suitable environment, such as a passenger cabin of a vehicle. The heating system 10 may be configured to heat the passenger cabin of any suitable vehicle, such as any suitable passenger vehicle, mass transit vehicle, utility vehicle, recreational vehicle, construction vehicle/equipment, military vehicle/equipment, watercraft, aircraft, etc. The heating system 10 may be configured to heat any other suitable environment as well, such as one or more rooms, or areas of, a building.

The heating system 10 generally includes a compressor 12, which compresses refrigerant flowing through a refrigerant line 14. Along the refrigerant line 14 downstream of the compressor 12 is a compressor discharge pressure sensor 16, which senses the pressure of refrigerant discharged by the compressor 12. The compressor discharge pressure sensor 16 is along the refrigerant line 14 between the compressor 12 and a condenser 20. The refrigerant line 14 extends from the condenser 20 to an evaporating heat exchanger 30. The refrigerant line 14 extends from the evaporating heat exchanger 30 back to the compressor 12.

The condenser 20 may be any suitable condenser, such as an air to refrigerant heat exchanger, which releases heat from the refrigerant to the air of the surrounding environment, such as the passenger cabin of the vehicle, to heat the environment. The condenser 20 may in some applications be a water cooled condenser, which transfers heat from the refrigerant to a coolant, and then heat from the coolant is released to the passenger cabin through a heater core. The evaporating heat exchanger 30 absorbs heat, and thus can be configured to cool the passenger cabin, or cool any suitable electronics or battery. For example, the evaporating heat exchanger 30 may be configured to cool a battery configured to propel the vehicle (such as in the case of a hybrid electric vehicle or a battery electric vehicle (BEV)).

The heating system 10 further includes a first valve 42 arranged along the refrigerant line 14 between the compressor 12 and the condenser 20, such as between the sensor 16 and the condenser 20. A second valve 44 may also be included, such as between the condenser 20 and the evaporating heat exchanger 30. The first and second valves 42 and 44 may be any suitable valves configured to control flow of refrigerant through the refrigerant line 14, such as expansion valves.

The heating system 10 further includes a controller 50. In this application, the term "controller" may be replaced with the term "circuit." The term "controller" may refer to, be part of, or include processor hardware (shared, dedicated, or group) that executes code and memory hardware (shared, dedicated, or group) that stores code executed by the processor hardware. The code is configured to provide the features of the controller 50 and systems described herein. The term memory hardware is a subset of the term computer-readable medium. The term computer-readable medium, as used herein, does not encompass transitory electrical or electromagnetic signals propagating through a medium (such as on a carrier wave); the term computer-readable medium is therefore considered tangible and non-transitory. Non-limiting examples of a non-transitory computer-readable medium are nonvolatile memory devices (such as a flash memory device, an erasable programmable read-only memory device, or a mask read-only memory device), volatile memory devices (such as a static random access memory device or a dynamic random access memory device), magnetic storage media (such as an analog or digital magnetic tape or a hard disk drive), and optical storage media (such as a CD, a DVD, or a Blu-ray Disc).

The controller 50 is connected to any suitable temperature sensor 52 to receive inputs regarding the temperature of the vehicle passenger cabin, or other area to be heated by the heating system 10. When the controller 50 receives an input from the temperature sensor 52 indicating that the temperature of the area to be heated is below a set temperature threshold (such as a passenger set temperature threshold) and the compressor 12 is already at maximum speed or a predetermined high speed, the controller 50 operates the first valve 42 to partially close the first valve 42, thereby restricting flow of refrigerant through the refrigerant line 14 to the condenser 20. Restricting refrigerant flow from the compressor 12 to the condenser 20 forces the compressor 12 to work harder, which increases the compressor discharge pressure. For example, the controller 50 may be configured to close the first valve 42 until the compressor discharge pressure as measured by the sensor 16 increases to a relatively high pressure, such as 2.2 MPa gauge for example. Once the passenger cabin has been warmed above a passenger set temperature (e.g., 50° C.), the controller 50 is configured to reopen the first valve 42, which will reduce the power consumption of the compressor 12 to its standard operation consumption. Thus the compressor discharge pressure of the refrigerant is inversely proportional to the degree to which the first valve 42 is open/closed by the controller 50.

Partially closing the first valve 42 advantageously increases the heating performance of the condenser 20 by increasing the power consumption of the compressor 12, which results in the compressor 12 working harder to increase the compressor discharge pressure, which increases the heating performance of the condenser 20. The heating performance of the condenser 20 is increased by about 0.5 kW or 1 kW, which advantageously increases customer comfort without the need for additional costly components, such as an auxiliary heater, which itself may generate 1 kW.

FIG. 2 illustrates the heating system 10 with additional components, and optimized for an electric vehicle application. In the application of FIG. 2, the heating system 10 includes cabin condenser 20A and outside condenser 20B. Both the cabin condenser 20A and the outside condenser 20B are arranged along refrigerant lines 14 downstream of the compressor 12. Refrigerant flow to the cabin condenser 20A is controlled by valve 42, and refrigerant flow to the outside condenser 20B is controlled by valve 44. The system 10 of FIG. 2 also includes: an outside subcool heat exchanger 30A; a cabin evaporator 30B; and a second evaporator 30C for cooling any suitable electronics, such as a battery pack for propelling the vehicle. Valve 46 controls flow of refrigerant to the cabin evaporator 30B. Valve 48 controls flow of refrigerant to the second evaporator 30C. The valves 46 and 48 have shut-off capability. Downstream of the cabin condenser 20A is a check valve 62. Downstream of the outside condenser 20B is a check valve 64.

Refrigerant lines 14 extending from the cabin condenser 20A and the outside condenser 20B connect to a receiver dryer 60. Downstream of the receiver dryer 60 between the receiver dryer 60 and the outside subcool heat exchanger 30A is a three-way valve 66. Refrigerant enters the three-way valve 66 from the receiver dryer 60, and the three-way valve 66 is configured to direct refrigerant flow to the outside subcool heat exchanger 30A and/or along a bypass around the outside subcool heat exchanger 30A.

The controller 50 is configured to control the first valve 42 in the same manner described above in conjunction with the description of the heating system 10 of FIG. 1. Thus the present disclosure advantageously provides for a controller 50 configured to partially close the valve 42 when the temperature sensor 52 identifies a temperature at the area to be heated (such as a vehicle passenger cabin) as being below a passenger set temperature. Partially closing the valve 42 reduces the flow of refrigerant to the condenser 20 or the cabin condenser 20A. As a result, the compressor 12 works harder and increases power consumption, thereby increasing the discharge pressure of refrigerant compressed by the compressor 12. This highly compressed refrigerant increases the heating performance of the condenser 20 and the cabin condenser 20A as the refrigerant flows through the condensers 20 and 20A. As a result, the heating performance of the condensers 20 and 20A is increased by about 1 kW without the need for adding additional heating components, such as an auxiliary heater. One skilled in the art will appreciate that the present disclosure provides numerous additional advantages and unexpected results as well.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A heating system comprising:

a temperature sensor configured to measure a temperature of a vehicle passenger cabin;

a condenser;

an evaporator;

a compressor along a refrigerant line, the compressor configured to compress refrigerant flowing to the condenser;

a first valve along the refrigerant line between the compressor and the condenser; and a controller in communication with the temperature sensor and configured to partially close the first valve when the temperature of the vehicle passenger cabin as measured by the temperature sensor is below a threshold to increase discharge pressure of refrigerant compressed by the compressor and increase heat dissipation of the condenser.

2. The heating system of claim 1, wherein the condenser is an air to refrigerant heat exchanger.

3. The heating system of claim 1, wherein the condenser is a water-cooled condenser.

4. The heating system of claim 1, wherein the condenser is a vehicle cabin condenser.

5. The heating system of claim 1, wherein the evaporator is a vehicle cabin evaporator for cooling the cabin.

6. The heating system of claim 1, wherein the evaporator is configured to cool a battery.

7. The heating system of claim 1, wherein the evaporator is configured to cool electronics.

8. The heating system of claim 1, wherein the evaporator is configured to absorb heat from ambient air.

9. The heating system of claim 1, further comprising a compressor discharge pressure sensor along the refrigerant line between the first valve and the compressor.

10. The heating system of claim 1, further comprising a second valve along the refrigerant line between the condenser and the evaporator, the second valve is an expansion valve.

11. The heating system of claim 1, wherein the controller is configured to partially close the first valve until the discharge pressure increases to 2.2 MPa Gauge.

12. The heating system of claim 1, wherein the controller is further configured to reopen the first valve when the measured temperature is at or above the threshold.

13. The heating system of claim 1, wherein partially closing the first valve when the measured temperature is below the threshold increases performance of the heating system by at least 0.5 kW;

wherein the threshold is a passenger set threshold.

14. The heating system of claim 1, further comprising a receiver drier along the refrigerant line between the condenser and the evaporator.

15. A heating system for a vehicle passenger cabin comprising:

a compressor;

a cabin condenser in receipt of refrigerant compressed by the compressor;

an outside condenser in receipt of refrigerant compressed by the compressor;

a first valve between the compressor and the cabin condenser;

a second valve between the compressor and the outside condenser;

a cabin evaporator;

a secondary evaporator; and a controller configured to partially close the first valve when a measured temperature is below a threshold to increase discharge pressure of refrigerant compressed by the compressor and increase heat dissipation of the condenser.

16. The heating system of claim 15, wherein the secondary evaporator is configured to cool a battery pack.

17. The heating system of claim 15, further comprising an outside subcool heat exchanger along a refrigerant line downstream of the cabin condenser and the outside condenser.

18. The heating system of claim 15, wherein the controller is configured to partially close the first valve until the discharge pressure increases to 2.2 MPa Gauge.

19. The heating system of claim 15, further comprising a compressor discharge pressure sensor along the refrigerant line between the compressor and the first valve.

20. The heating system of claim 15, wherein partially closing the first valve when the measured temperature is below the threshold increases performance of the heating system by at least 0.5 kW; and wherein the threshold is a passenger set threshold.

* * * * *